United States Patent [19]

Kirby et al.

[11] 4,011,825

[45] Mar. 15, 1977

[54] SWASH PLATE

[75] Inventors: William Everett Kirby, Victoria, Hong Kong; David Jackson Seymour, Daly City, Calif.

[73] Assignee: Wharton Shipping Corporation, Panama, Panama

[22] Filed: Apr. 20, 1976

[21] Appl. No.: 678,623

Related U.S. Application Data

[63] Continuation-in-part of Ser. No. 583,440, June 3, 1975, abandoned.

[52] U.S. Cl. ..... 114/260; 114/75

[51] Int. Cl.[2] ..... B63B 25/00

[58] Field of Search ..... 114/43.5 VC, 26, 72, 114/75, 78, 116, 125

[56] References Cited

UNITED STATES PATENTS

| | | | |
|---|---|---|---|
| 1,533,776 | 4/1925 | Tiburtius | 114/43.5 VC |
| 2,347,876 | 5/1944 | Braun et al. | 114/26 |
| 3,186,369 | 6/1965 | McLennan et al. | 114/43.5 VC |
| 3,191,568 | 6/1965 | Schroeder et al. | 114/43.5 VC |
| 3,537,413 | 11/1970 | Farrell | 114/43.5 VC |

*Primary Examiner*—Trygve M. Blix
*Assistant Examiner*—Gregory W. O'Connor
*Attorney, Agent, or Firm*—Owen, Wickersham & Erickson

[57] ABSTRACT

A waterborne vessel capable of carrying in its partially submerged hold a predetermined number of buoyant cargo containers, each container being partially supported by its own buoyancy and also engaged by the vessel, resulting in exchange of buoyancy between each container and the vessel. Plural hinged swash bulkheads are provided, and when the vessel is loaded to less than full capacity, some of the swash bulkheads are raised to an upright position at predetermined locations in the bottom hull structure of the vessel to resist potentially damaging forces of sloshing waters therein. When a full load of cargo containers is carried in the hold, the swash bulkheads are retracted to a stowed position in the bottom structure of the hull.

20 Claims, 16 Drawing Figures

SWASH PLATE

REFERENCE TO RELATED APPLICATION

This application is a continuation-in-part of application Ser. No. 583,440, filed June 3, 1975, now abandoned.

BACKGROUND OF THE INVENTION

This invention relates to improvements in a vessel for transporting floatable buoyant cargo units in which the buoyancy of the cargo is in part transferred to support a substantial portion of the transporting vessel's own weight. More particularly, this invention relates to a vessel with engageable hinged swash bulkheads for impeding the sloshing of water within the flooded hold of the vessel when it is carrying fewer buoyant cargo units than its full load capacity of such cargo units.

In vessels of the type utilizing the present invention, the hull structure serves to contain a predetermined number of cargo units secured by a locking mechanism and at the same time to provide a smooth external envelope of a desired form to minimize hydrodynamic resistance. At the same time, the hull enables employment of the buoyancy of the cargo units by always maintaining a flooded cargo hold which is common with the waterway or sea. This may be done, for example, by means of permanent openings in the bottom of the hull for free passage of water in and out. Such a type of vessel is more particularly described in our copending application Ser. No. 511,492, now U.S. Pat. No. 3,913,512, issued Oct. 21, 1975.

From time to time during the operations of such a vessel there may not be a full complement of cargo units for transport on a given voyage, and a lower-than-capacity number of cargo units will then be loaded and secured therein. Without a full complement of cargo units, a free surface of unrestrained water will then be present in the flooded hold. In such a partly loaded situation the cargo units actually present in the hold may become subjected to severe and even destructive pressures from the sloshing effect of water induced by the pitching and other movements of the vessel during its voyage. The present invention is directed to the protection of the cargo units from such sloshing water forces in this situation.

SUMMARY OF THE INVENTION

The present invention protects the cargo units by providing engageable swash bulkheads which are hinged to the bottom hull structure of the vessel. Under vessel loading conditions which otherwise would expose a less-than-full capacity load of cargo units to sloshing forces and resulting pressures, one or more of these bulkheads is raised into an upright position by an elevation-and-retraction mechanism secured to the vessel. The raised swash bulkheads are then secured in the upright position by engagement by the same engagement mechanism that is used to lock the cargo units securely within the hold of the vessel. The number and positions of the hinged bulkheads of the present invention may be designed to accommodate a variety of combinations of cargo units numbering less than the capacity of the vessel, up to full capacity.

Other objects and advantages of the invention will appear from the following description of a preferred form of the invention.

DETAILED DESCRIPTION OF THREE PREFERRED EMBODIMENTS

Figure 1:
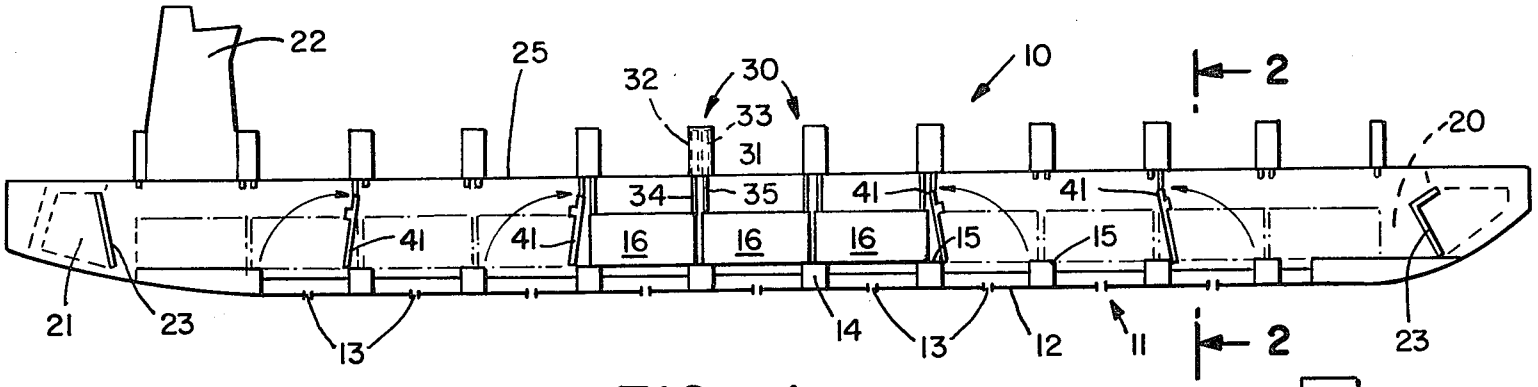
FIG. 1 is a somewhat schematic view in side elevation and in section of a vessel embodying the principles of the invention. Three barges or lighters are locked in place amidships within the flooded hold of the vessel, representing a partial load, and the empty spaces show, in broken lines, four forward barge or lighter positions and four aft barge or lighter positions. Four hinged swash bulkheads of the present invention are shown locked in a fully engaged upright configuration.
Figure 2:
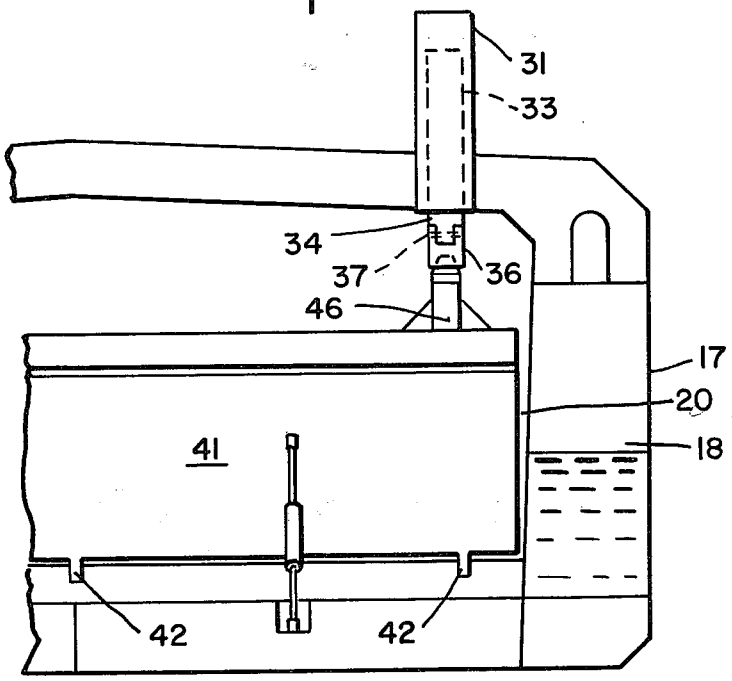
FIG. 2 is a fragmentary view in section and elevation taken along the line 2—2 of FIG. 1.
Figure 3:
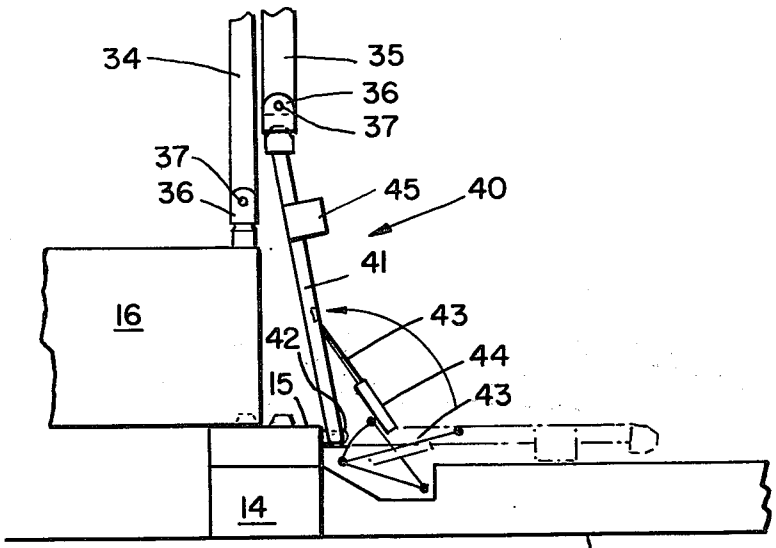
FIG. 3 is a fragmentary detail view in side elevation and in section of the vessel of FIG. 1 showing one of the hinged swash bulkheads of the present invention shown in solid lines as locked in its upright position and shown in broken lines as retracted and horizontal.

A vessel 10 with a single hold (FIGS. 1–3)

In a vessel 10 such as that shown in the drawings, the ship 10 is provided with a suitable hull 11 having a perforate bottom shell 12 with inlet openings 13 that at all times are open to the body of water in which the vessel 10 floats. The shell 12 can then be relatively thin, for the water exerts equal pressure on both surfaces thereof. The hull 11 is preferably strengthened by bottom transverse box girders 14 to take a suitable load, the hull 11 and girders 14 being shaped so that there will be a flat surface 15 for a series of substantially identical floatable containers 16, such as lighters or barges.

The buoyant sidewalls 17 of most of the hull 11 comprise a series of watertight buoyancy tanks or compartments 18 which are filled or emptied of water to adjust and maintain the waterline of the vessel 10 to the proper level to enable loading of the barges and lighters 16 into a hold 20, as well as to control buoyancy transfer between them and the vessel 10.

At the aft end of the vessel 10 is a propulsion portion 21, which may be constructed substantially as is satisfactory in any such vessel, and there may be suitable and necessary crew accommodations and operating locations 22, etc.

A suitable gate 23 for flotation loading and unloading of containers 16 may be provided at either end or at both ends of the vessel 10. Hinged gates 23 at either end or at both ends of the vessel would be raised during loading and unloading operations to admit the floatable containers 16 into or to enable their removal from the hold 20, and would be lowered into the positions shown in FIG. 1 during transport operations.

As shown in FIG. 1, a principal cargo for the vessel preferably comprises a series of containers 16, such as standardized covered lighters or barges, each of which is a standard member and each of which is outfitted with standard equipment. In the vessel 10 the barges or lighters 16 are typically floated in through the bow in a train or tandem series. The barges or lighters 16 are typically retained in the hold 20, sideways, the width of the hold 20 being a little greater than the length of each barge 16.

In the vessel 10 of FIG. 1 it may be seen that there are 11 positions for containers 16. As illustrated in FIG. 1, operating conditions may well occur wherein not all 11 positions are occupied by containers. The present invention enables the ship 10 to accommodate safely a series of a lesser number of containers, such as the three containers 16 shown. Series of four to 11 containers 16 may also be loaded.

During loading operations, the vessel's buoyancy tanks 18 are ballasted and the three containers 16 are then positioned amidships in the vessel. The ballast will lower the vessel 10 so that the heaviest laden of the three barges or lighters 16 will float over the cross girders 14 of the hull 11. The containers 16 are aligned during deballasting so that adjacent ones will eventually seat on the flat surface 15 of each of the cross girders 14 of the hull 11 or, in some instances, on projections extending up from the surface 15 and engaging sockets in the containers 16. However many containers 16 are loaded, they are centered in the vessel 10 as much as is possible. Above the containers 16 and suspended from a deck 25 in a series of extensible hydraulic (or pneumatic) devices 30, each of which comprises a stationary housing 31 secured to the deck 25. In each housing 31 is secured a pair of stationary cylinders 32 and 33 and a corresponding pair of movable pistons 34 and 35 (alternatively, movable cylinders and stationary pistons may be used). At the end of each piston 34 or 35 there is a movable spud member 36 which may be secured by a trunnion pin 37. Thus, when pressurized hydraulic fluid or compressed air is sent through controls by a port into the cylinder space between the upper end of the piston 34 and the cylinder 32, the piston 34 is moved down and carries with it an outer spud 36. When the fluid is withdrawn from the space between the cylinder 32 and the upper end of the piston 34, it is retracted upwardly. Each spud 36 has suitable means for engaging its container 16. For example, there may be a projection at each corner of a container 16 and the spud 36 may have a receptacle therefor.

When the three containers 16 are engaged by the appropriate spuds 36 and are seated at their lowermost positions on the flat surfaces 15 (or projections thereon), they are secured in place. As explained in our U.S. Pat. No. 3,913,512, the vessel 10 advantageously utilizes a buoyancy transfer action. For example, before being secured within the vessel 10, each container 16 has its own waterline, and typically, some containers 16 have a higher waterline than others. When floating freely, all three containers shown in FIG. 1 would be buoyant, but would have varying drafts and varying waterlines. When secured in place by the buoyancy transfer and securing means described hereinabove they appear as in FIG. 1 all held at the same level. Thus, there is an interchange of buoyancy between the vessel 10 and the containers 16, and the waterline of the vessel 10 can be adjusted by virtue of the filling and discharge of the ballast tanks 18 to cause the buoyancy of the containers 16 to help buoy the vessel as well as help carry the load therewithin.

As previously indicated, the vessel 10 contains 11 container positions, but with the particular loading conditions shown by way of example in FIG. 1, only three containers 16 are in place amidships. It will be remembered that during the voyage the vessel 10 is ballasted so that the hold 20 is partially submerged, and water freely passes between the hold and the waterway via the openings 13. During the voyages, pitching and other movement of the ship would cause water within the hold 20 to slosh, and such sloshing water, if not dispersed, would present undesirable, severe loads and pressures upon the three containers 16 which might jar them loose or even damage their hull structure. Thus, in accordance with the present invention, plural-hinged swash bulkheads 40 have been provided to protect the three containers 16 from the dynamic pressures and forces of sloshing water in the hold 20. As shown in the drawings, each swash bulkhead 40 may comprise a transverse reinforced member 41 which is hinged to a transverse box girder 14 by hinges 42. The swash bulkhead member 41 is elevated from a normally horizontal orientation to an upright position by such means as an elevation linkage 43 which is driven by a hydraulic cylinder 44. The linkage 43 is pivotally connected between the member 41 and the structure of the hull 11 to lift the bulkhead 41 and provide reinforcement of the bulkhead 40 when it is in the upright position. A box girder 45 may be included as part of the fabrication of the member 41. At the end of the member 41 opposite the hinge 42, a pair of corner post projections 46 (e.g., as used on LASH-system barges) may be secured in position to mate with receptacles at the end of a corresponding pair of spuds 36. Other types of locking means may be used on barges. The spuds 36 (or other locking means) enable the swash bulkhead 40 to be locked between the transverse girder 14 and the deck structure 25, so that the swash bulkhead 40 is effective in dispersing sloshing pressures which may occur from time to time within the flooded hold 20 of the vessel 10.

As is readily apparent from the drawings, during conditions of full loading, when all 11 container positions are occupied by containers 16, the swash bulkheads 40 are not needed and are, therefore, retracted to their normally horizontal or stowed position by operation of the hydraulic cylinder mechanism 44 and the linkage 43. Also, while FIG. 1 shows the stowage of three containers or lighters 16, it is apparent that alternate configurations as suggested by FIG. 1 would enable the placement of one, two, four, five, six, seven, eight, or nine containers in a vessel sized for 11 containers merely by erecting said hinged swash bulkheads 40 as are appropriate. Thus, to be effective for a loading of six or seven containers 16, a combination of two swash bulkheads 40 will be used in the hold 20 of the vessel 10 to protect the combination of stowed containers or lighters 16. One bulkhead 40 is then forward of the containers 16 and the other bulkhead 49 is aft of the containers 16.

Figure 4:
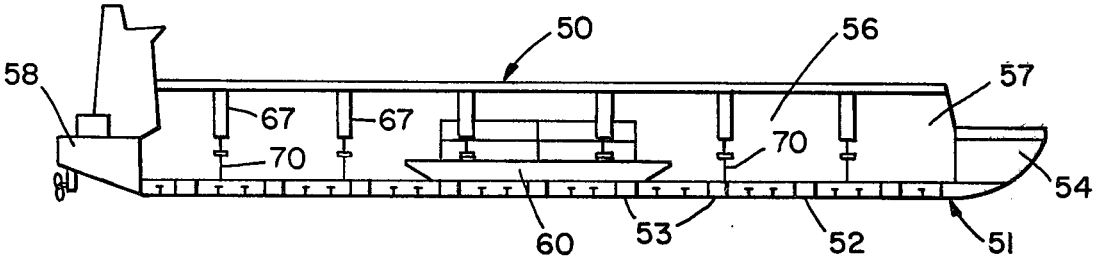
FIG. 4 is a somewhat schematic view in side elevation and section of the starboard hold of a vessel embodying the principles of the invention. A "Coaster" type of barge is positioned amidships in the starboard hold, and four hinged swash bulkheads are shown locked in upright positions, two forward and two aft of the barge.
Figure 5:
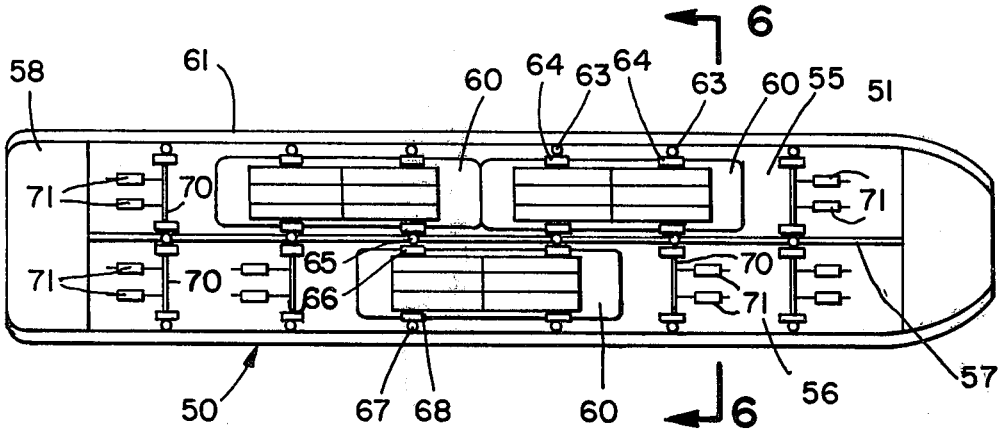
FIG. 5 is a top plan view of the vessel of FIG. 4, with the deck removed to show the port and starboard holds. Two Coaster type barges are positioned amidships in the port hold and one in the starboard hold. Two swash bulkheads are in the upright position of the port hold in addition to the four in the starboard hold. The holds are divided by a longitudinal bulkhead aligned with the keel of the vessel.
Figure 6:
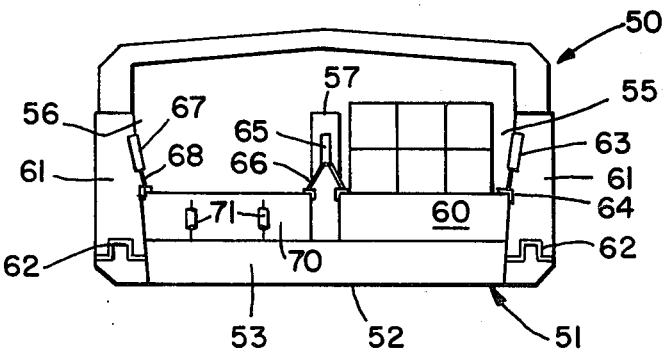
FIG. 6 is a view in elevation and in section taken along the line 6—6 in FIG. 5.

A twin-hold vessel 50 (FIGS. 4–6)

A vessel 50, utilizing the same type of transfer of buoyancy principle described hereinabove and adapted for carrying larger buoyant cargo units, is described in FIGS. 4–6. This vessel 50 is provided with a hull 51 having a bottom shell 52 surmounted by reinforcing bottom transverse box girders 53 which are spaced apart along the bottom of the hull 51. Flotation loading of the vessel 50 may be provided by a bow gate 54 which is hinged to be raised during loading operations. Entry at the stern through suitable raised superstructure is equally satisfactory.

Two parallel holds 55 and 56 are provided in the hull 51 by virtue of a longitudinal bulkhead 57, which extends from the bow 54 to near the stern 58 along the centerline of the vessel 50. Each hold 55 and 56 is adapted to hold a maximum of three buoyant cargo units 60, such as China Coaster barges in an end-to-end tandem configuration.

As shown in FIG. 5, although the holds 55 and 56 may accommodate six barges 60, under certain circumstances loading of, say, three such barges 60 may be safely accomplished in accordance with the principles of the present invention. Thus, the drawing shows two barges 60 in the port hold 55 and one barge 60 in the starboard hold 56. The barges 60 are positioned amidships, and, as in the case of the first-described preferred embodiment, the vessel 50 provides buoyancy tanks 61 for ballasting and deballasting to adjust the draft of the vessel 50. The holds 55 and 56 remain constantly flooded to the sea by virtue of flood pipes 62 in the sidewall portion of the hull.

Three series of extensible locking devices are provided in the vessel 50. One series 63 extends along the port sidewall at spaced apart positions. Each device 63 includes an engagement member 64 suitable to engage a suitable portion of an upper port edge of the barge 60 placed in the port hold 55. A second extensible locking member series 65 is secured in the central longitudinal bulkhead 57. Each device 65 includes an extensible locking member 66 which has portions extending into both of the holds 55 and 56 so that adjacent barges 60 may be secured by the same engagement members 66. A third series of devices 67 is provided in the starboard portion of the hull 51. As with the other devices, the starboard series each includes an engagement member 68 for engaging substantial portion of the starboard upper edge of a barge 60.

As with the previously described preferred embodiment the vessel 50 provides plural-hinged swash bulkheads 70 which may be pivotally connected to the transverse box girders 53. Hydraulic actuators 71 may be utilized to raise the bulkheads 70 to an upright position to prevent swash during loading conditions at less than full barge capacity in the vessel 50. Once raised, the swash bulkheads 70 may be locked in place by cooperative engagement with the members 64, 66, and 68 of the extensible locking devices 63, 65, and 67 respectively. In the alternative, the actuators 71 may be strengthened to provide sufficient bracing for each swash bulkhead 70 for safe operation without engagement of the extensible members 63, 65, and 67. In the configuration shown in FIG. 5, two swash bulkheads 70 are utilized in the port hold 55, with one bulkhead 70 raised in front of the forward barge 60 and the other bulkhead 70 raised after the rear barge 60. In the starboard hold 56 two swash bulkheads 70 may be raised forward of the barge 60 and two aft thereof.

FIGS. 7 through 13 show another embodiment of a stowable swash bulkhead 75 which may be used in the barge carrying vessels 10 and 50 illustrated in FIGS. 1 through 3 and 4 through 6, respectively. The swash bulkheads 75 may be employed to prevent sloshing when the vessel carries less than a full capacity of cargo units, precisely in the same manner as that described above in connection with either of the first two embodiments, except that the swash bulkheads 75 are structurally different from the bulkheads 41 and 70 and are raised into engaged position in a different manner.

Figure 7:
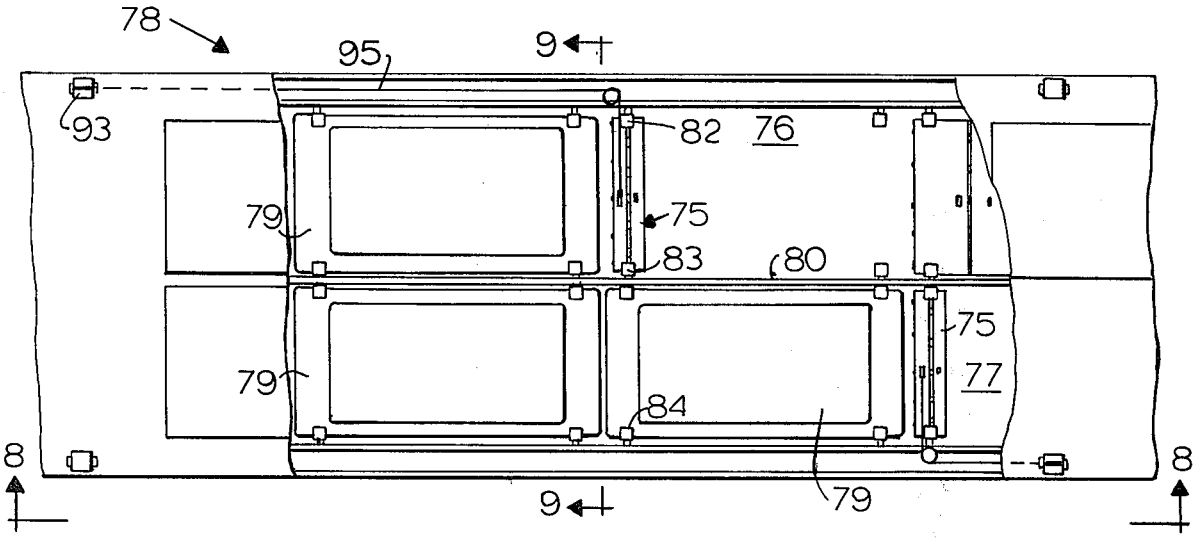
FIG. 7 is a fragmentary top plan view of a vessel similar to that shown in FIG. 4 but including an alternate form of swash bulkheads. The deck is removed to show barges or lighters of the type illustrated in FIG. 4, with the modified form of swash bulkheads in raised upright configuration in some of the empty barge positions.
Figure 8:
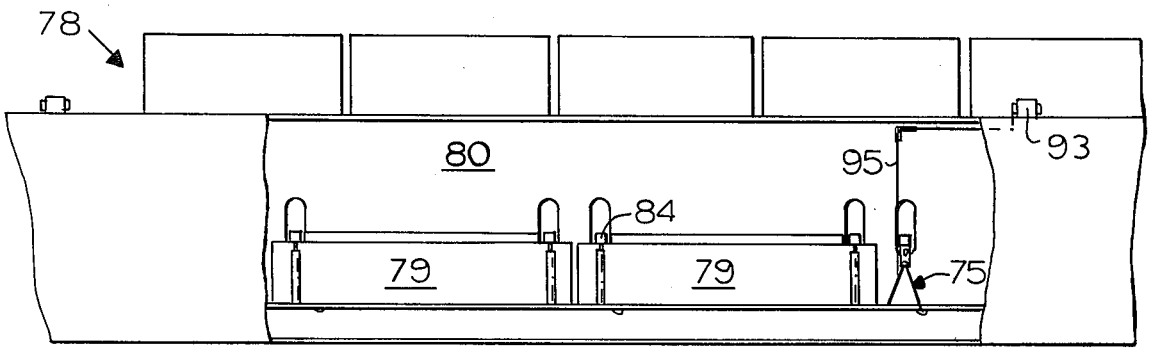
FIG. 8 is a fragmentary partially broken away side elevational view of the vessel of FIG. 7, taken along the line 8—8 of FIG. 7.
Figure 9:
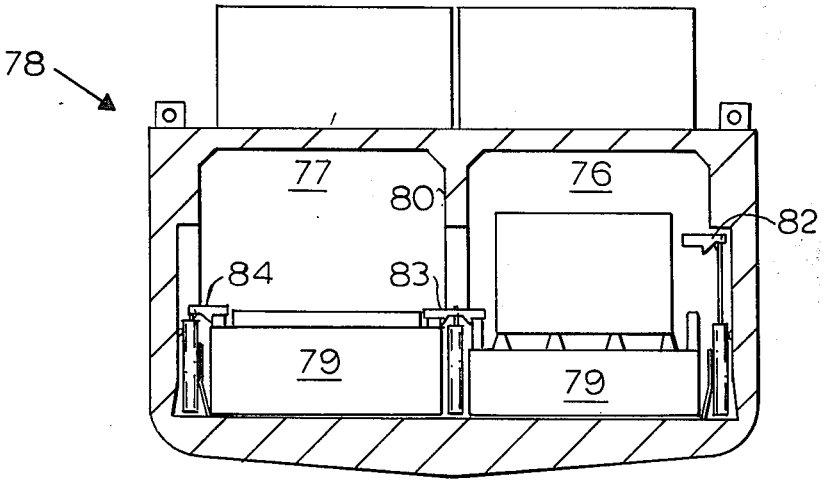
FIG. 9 is an elevational view in section of the vessel, taken along the line 9—9 of FIG. 7 and showing two barges or lighters of different heights within the vessel.

As shown in FIG. 7 a fragmentary plan view showing the port and starboard holds 76 and 77 of a twin-hold vessel 78, with the deck of the vessel removed, three barges or other type of buoyant cargo units 79 may be positioned centrally in the vessel with other barge positions left vacant. Two of the barges may be located on one side of a central longitudinal bulkhead 80 and one on the other side. As indicated, the protective swash bulkheads 75 may be in the raised, upright position adjacent to ends of the barges 79 or in other locations as desired. A swash bulkhead may be included at the location of each pair of hold-down devices on either side of the central bulkhead 80, or they may be omitted in locations which will almost always carry barges, such as locations near the center of the hold. These hold-down devices 82, 83, and 84 on the port side, on the central bulkhead and on the starboard side of the vessel may be similar to the devices 63, 65 and 67 described above, but the devices 82, 83, and 84 shown in FIGS. 8, 9, and 14–16 are mounted from the floor of the hold, rather than from above as described in connection with FIGS. 1 through 6. In FIGS. 8 and 9 the devices 82, 83, and 84 are shown holding down barges 79 against the floor of the vessel's holds, with the device 82 in FIG. 9 shown raised but prepared for engagement with the adjacent barge 79. The two barges 79 are of different heights, as will be discussed further below. FIGS. 7 and 8 also show the devices 82, 83, and 84 holding down engaged swash bulkheads 75 to securely maintain them in position for dampening the water slosh. The structure of these alternate forms of hold-down devices, which may similarly be used in the embodiments of FIGS. 1 through 6, will be more fully explained below.

Figure 10:
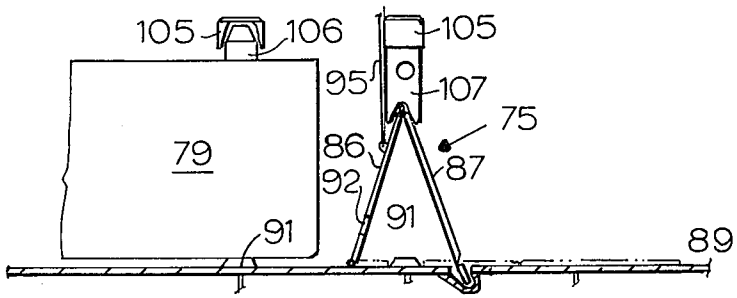
FIG. 10 is an enlarged view, partly in section, of a portion of FIG. 8, illustrating a raised upright swash bulkhead in side view and indicating its stowed position in dashed lines.
Figure 11:
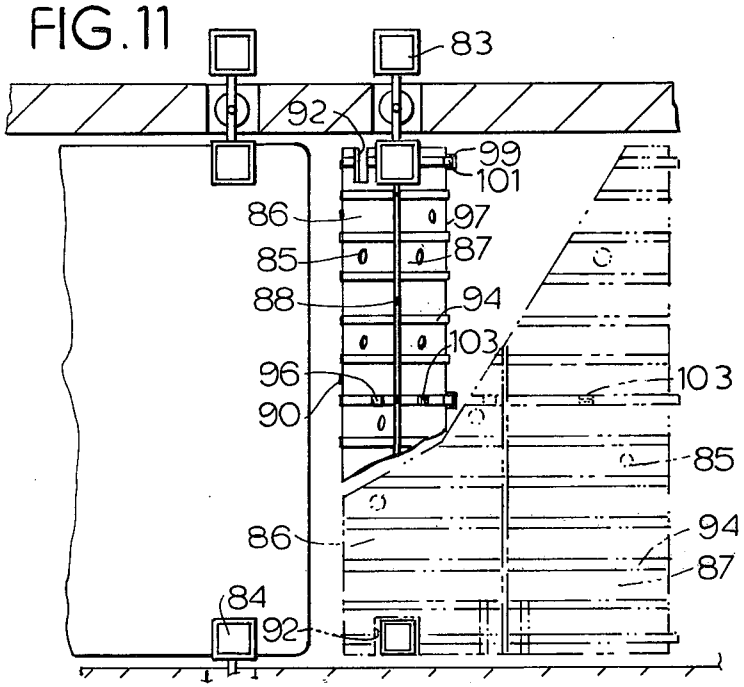
FIG. 11 is a top plan view of the swash bulkhead of FIG. 10. An erected swash bulkhead is shown in solid lines, and the flat stowage position thereof is shown in broken lines.

Each swash bulkhead 75 is formed of two generally flat plates 86 and 87 connected together by a hinge 88 (or a plurality of aligned hinges 88), as shown in FIGS. 10 and 11. Both plates 86 and 87 may include openings 85 for permitting flow, but not sloshing, of water. The plate 86 is also pivoted to a floor 89 or hull-reinforcing structure of the hold by one or more hinges 90, so that the swash bulkhead 75 can either be stowed flat as shown in dashed lines in FIGS. 10 and 11 or raised to an engaged upright position as shown in solid lines. Since footings 91 may be provided on the hold floor to support the barges or lighters 79, an opening 92 is provided in each edge of the plate 86 as indicated, so that when the swash bulkhead 75 is stowed flat, the adjacent footing protrudes through the opening 92 so that it can engage a barge.

The plates 86 and 87 preferably include structural ribs 94 on thin outer surfaces, extending parallel to the length of the vessel. These help support the downward force exerted by the hold-down devices 82, 83, and 84 and thus help provide for the security of the swash bulkheads in the engaged position.

As FIGS. 10 and 11 illustrate, a stowed swash bulkhead 75 may be raised into the upright engaged position by lifting on one of the plates 86 and 87 as by a line 95. The line 95 preferably extends from a connector or anchor 96 on the floor-mounted plate 86, located at a central position adjacent to the line of hinges 88. Its other end may be connected via appropriate pulleys (not shown in detail) to a winch such as the above-positioned winch 93 schematically indicated in FIG. 8, which may also be used for aiding in the movement of cargo units. The attachment of the line 95 to the connector 96 is by suitable removable attachment means such as a hook (not illustrated), so that the line can be retracted when not needed.

Figure 12:
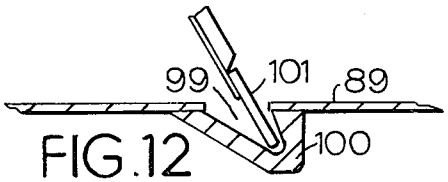
FIG. 12 is an enlarged detail view in elevational section showing a lock foot of the swash bulkhead and its retention in the hold floor.

When the hinged central area of the swash bulkhead 75 is raised, its lower free end 97 on the plate 87 slides toward the floor hinges 90 until it passes over a series of locking slots 99 formed in the floor 89 by brackets 100 fastened therebelow, as shown in FIG. 10 and in the detail view of FIG. 12. Each of the slots 99 is engaged by a locking foot 101 extending from the free end 97 of the swash bulkhead as shown. Each locking foot 101 drops into a slot 99 when it reaches the slot, firmly locking the swash bulkhead in the upright position. As FIG. 11 indicates, three lock feet 101 may be provided (or any number), with an equal number of locking slots 99 appropriately located in the positions indicated in FIG. 10. The locking feet may be welded or otherwise fastened onto the plate 87 as shown, or they may comprise extension of some of the structural ribs 94.

For return of the swash bulkhead to the flat stowed position, the winch line 95 may be attached to a stowing connector or anchor 103 appropriately located on the plate 87. Both the connectors 103 and 96 are preferably located on one of the structural ribs 94 for reinforcement. The position of the connector 103 between the free end 97 and the hinges 88 of the plate 87 is such that when it is pulled by the line 95, it lifts the lock feet 101 out of the slots 99 and allows the plate 87 to rotate counterclockwise somewhat, but not entirely to the flat position immediately. Thus, as the swash bulkhead 75 is suspended by the line 95 and connector 103, its lock feet are in a position above and to the right of the slots 99 as viewed in FIGS. 10, 11, and 12, but the angular configuration of the swash bulkhead is not drastically different from its engaged configuration. Thus, it may then be lowered into the flat stowed position by letting out the suspending line 95. It should be noted that the proper positioning of the stowing connector 103 depends upon the location of the center of gravity of the plate 87, the angle between the two plates 86 and 87 in the upright position, the weight of the plate 86 bearing against the plate 87, and the angle at which the winch line 95 depends from above to the stowing connector 103.

Although the swash bulkheads 75 have been illustrated and described in connection with a twin-hold vessel 78 similar to the twin-hold vessel 50 of the second embodiment described above, they may also be employed in a vessel with a single hold such as the vessel 10 of the first described embodiment. In such case the swash bulkheads would extend throughout the width of the hold and would be located and employed in much the same manner as the swash bulkheads described in connection with that embodiment of the invention.

As illustrated in FIGS. 7, 8, 19, 11, and 13, one of the hold-down devices 82, 83, and 84 bears down at each end of each upright swash bulkhead 75 to hold it firmly in place against the action of moving water in the hold. Each hold-down device 82, 83, 84 may include a socketed spud 105 for engaging a post 106 at the corner of a barge 79 or a spacer 107 which transfers the pressure of the spud to the swash bulkhead below. The posts 106 may comprise block type spacers placed between the barge and the spud or may be permanently affixed to the barge. As shown in FIG. 9, the hold-down devices can accommodate barges of different heights by the use of posts 106 of the proper height, allowing the double-spudded center hold-down devices 83 to properly secure both barges. Similarly, the center hold-down devices 83 can retain a barge in the starboard hold and a swash bulkhead in the port hold (see FIG. 7), or vice versa, even though the two are of differing heights, through selection of the proper posts 106 and spacers 107.

Figure 13:
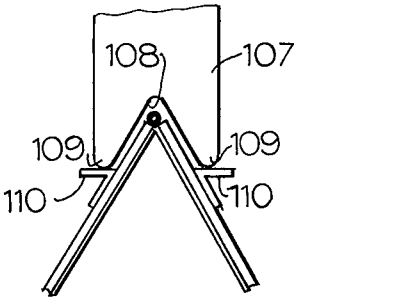
FIG. 13 is an enlarged detail view showing a manner in which a spacer member may be supported on an upright swash bulkhead to hold the bulkhead in place.

As indicated in FIG. 13, each spacer 107 preferably includes a V-shaped groove 108 shaped generally complementarily to the erect swash bulkhead 75, so that a forked end 109 results. Spacer bearing angles 110 may be included on the ribs 94 of the swash bulkhead 75 to accept the load of the spacer 107 and the hold-down device above, transmitted through the forked end 109.

Figure 15:
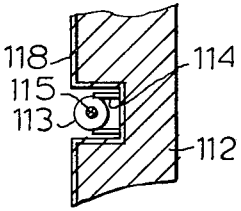
FIG. 15 is a plan view in section of the hold-down device, taken along the line 15—15 of FIG. 14.
Figure 16:
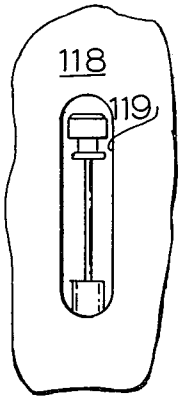
FIG. 16 is an elevational view of the hold-down device, taken along the line 16—16 of FIG. 14.
Figure 14:
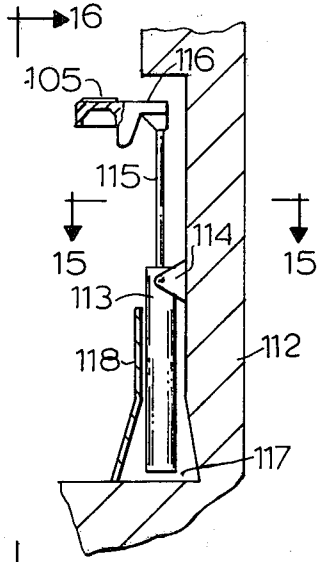
FIG. 14 is an elevational view in section of a hold-down device for barges or for swash bulkheads in the vacant barge positions, constituting an alternate form of hold-down means from that shown in FIGS. 1 through 6.

FIGS. 14 through 16 illustrate the structure of the hold-down devices 82 and 84 at the port and starboard sides of the vessel which may be used with the just described form of swash bulkhead 75 or with the earlier described embodiments. The central hold-down devices 83 mounted in the center longitudinal bulkhead 80 are similar, as indicated somewhat schematically in FIG. 9, but different in that they support two spuds 105 each instead of being mounted on structure in the top of the hold as described in connection with the embodiment of FIGS. 1 through 6, the hold-down devices 82,

83, and 84 are mounted in the vessel walls 112 (or the center bulkhead 80 in the case of the devices 83). Thus, the devices 82 and 84, for example, pull down on the barges 79, with the resultant force exerted upwardly on the vessel walls 112. Exchange of buoyancy between the barges 79 and the vessel 78 occurs in the same way as described above.

The wall-mounted hold-down devices 82 and 84 comprise hydraulic or pneumatic cylinders 113 preferably pivotally mounted to wall brackets 114. From each cylinder 113 a piston shaft 115 extends upwardly to a rigid connection with a mounting plate 116 retaining the spud 105. Exertion of fluid pressure in the cylinder between the piston (not shown) and the cylinder top causes the shaft 115 to retract and pull the spud 105 downwardly. The cylinder is preferably mounted within a hollow space 117 in the vessel wall as shown in the Figures, with an inner wall 118 having a vertically elongated opening 119 to accommodate the vertical movement of the protruding spud 105 and mounting plate 116.

To those skilled in the art to which this invention relates, many changes in construction and widely differing embodiments and applications of the invention will suggest themselves without departing from the spirit and scope of the invention. The disclosure and description herein are purely illustrative and are not intended to be in any sense limiting.

We claim:

1. In a waterborne vessel having a hull with rigid supporting and hull-reinforcing structure, a bow, a stern, and sidewalls providing a series of buoyancy compartments and a hollow interior defining at least one hold, means communicating between said hold and the sea water for enabling free passage of water into and out of said hold at all times and having gate means for flotation loading thereof, so that said hold is partially flooded, said vessel being for transport of a plurality of buoyant cargo carriers such as barges, lighters and pontoons placed by flotation loading through said gate means into predetermined locations within said hold, wherein each said carrier is partially supported by its own buoyancy and is also so connected to the vessel as to enable exchange of buoyancy between said carrier and said vessel and wherein the number of said predetermined locations may exceed the number of carriers placed in the hold on a given voyage, the improvement comprising:

movable swash blockage means secured within said hold for movement into a carrier-protecting position extending across substantially the entire width of said hold for protecting said carriers by impeding the slosh of flood water accumulated within said hold which may be induced by pitching and other motion of said vessel and for movement into a stowed position during flotaion loading and unloading of said carriers and for accommodation of additional carriers.

2. The improved vessel of claim 1 wherein each said predetermined location is provided with movable carrier-engagement means secured to said vessel for (1) movement into a carrier-engagement position for holding a carrier in said location after loading in order to obtain said exchange of buoyancy and (2) movement into a carrier loading an unloading position away from said carrier during flotation loading and unloading thereof, some of said carrier-engagement means also being movable into a position locking a said movable swash blockage means in its carrier-protecting position.

3. The vessel of claim 1 wherein said movable swash blockage means comprises a substantially imperforate transverse plate member pivotally mounted at one edge thereof to said hull.

4. The vessel of claim 3 wherein each said transverse plate member comprises two sections, each extending the full width thereof, hinged together along a horizontal line, said swash blockage means normally lying flat at the bottom of said hold and when erected being in an inverted V-shape with said horizontal line at the top.

5. The vessel of claim 1 having a plurality of said movable swash blockage means in said hold some located fore and some located aft of said carriers loaded in said hold.

6. A waterborne vessel having a hull with rigid supporting and hull-reinforcing structure, a bow, a stern, and sidewalls providing a series of buoyancy compartments and a hollow interior defining at least one hold, gate means in said hull for flotation loading of said hold, means communicating between said hold and the water for enabling free passage of water into and out of said hold at all times, so that said hold is partially flooded, said vessel being for transport of a series of buoyant cargo units such as barges, lighters and pontoons, each placed by flotation loading through said gate means into said hold, buoyancy adjustments being made to said buoyancy compartments for establishing the buoyancy of said vessel during a voyage at a waterline where each carrier is partially supported by its own buoyancy, comprising:

a plurality of movable swash blockage bulkheads, each pivotally secured at one edge within said hold to said supporting and hull-reinforcing structure for swinging movement from a substantially horizontal position where they do not interfere with loading, unloading, or stowing of a said unit to an erected substantially vertical cargo-protecting position there being some of said bulkheads fore and some aft of the longitudinal center of said vessel, each said bulkhead when erected serving to protect cargo units against the slosh of flood water accumulated in said hold which may be induced by pitching and other motion of said vessel, and a plurality of unit locking means secured to said vessel for locking units to said structure after loading for obtaining buoyancy exchange between said hull and said units, each swash blockage bulkhead when erected being engaged by at least one unit locking means for locking it firmly in place.

7. The vessel of claim 6 wherein each said unit locking means comprises an extensible post fitted with socket structure at an outboard end thereof; and said swash blockage bulkhead includes a fitting on a peripheral edge thereof opposite said pivotal edge for engagement by said socket structure.

8. The vessel of claim 6 additionally comprising powered bulkhead moving means pivotally connected between each said bulkhead and said structure for erecting said bulkhead and for lowering it to its substantially horizontal position.

9. The vessel of claim 8 wherein said powered bulkhead moving means includes brace means for bracing said bulkhead in its said cargo-protecting position.

10. The vessel of claim 9 wherein said powered bulkhead moving means comprises a hydrostatically driven extensible linking member pivotally connected between said bulkhead and said structure at a spaced away position from the pivotal mounting of said bulkhead to said structure, said linking member providing diagonal bracing between said structure and said bulkhead when it is in said cargo-protecting position.

11. The vessel of claim 6 wherein each said swash blockage bulkhead comprises at least a plate member, each member being joined by hinge mounting means on one horizontal edge to said hull-reinforcing structure and each said plate member being engaged by a said unit locking means at a horizontal edge thereof opposite said hinged edge.

12. The vessel of claim 11 additionally including for each plate member at least one extensible linking assembly for moving said plate into said cargo-protecting position and for returning said plate to its horizontal stowed position, said extensible linking assembly comprising two axially extensible arms with a hydraulic cylinder therebetween for axially moving said arms, said assembly being pivotally mounted between said plate and said structure in a configuration that provides diagonal bracing between said structure and said plate when it is in said cargo-protecting position.

13. The vessel of claim 6 wherein each said bulkhead comprises two portions of substantially the same height hinged together along a horizontal hinge line, the pivotal securement to hull-reinforcing structure being at an edge of one said portion only, the other said portion having a free edge, said bulkhead when erected defining a vertical inverted V, with the vertex thereof at said horizontal hinge line, said unit locking means engaging said vertex, and retention means secured to said hold engaging said free edge to hold it against movement.

14. A waterborne vessel having a hull with rigid supporting and hull-reinforcing structure, a bow, a stern, and sidewalls providing a series of buoyancy compartments and a hollow interior defining at least one hold, gate means in said hull for flotation loading of said hold, means communicating between said hold and the water for enabling free passage of water into and out of said hold at all times, so that said hold is partially flooded, said vessel being for transport of a series of buoyant cargo units such as barges, lighters and pontoons, each placed by flotation loading through said gate means into said hold, buoyancy adjustments being made to said buoyancy compartments for establishing the buoyancy of said vessel during a voyage at a waterline where each carrier is partially supported by its own buoyancy, comprising:

a plurality of movable swash blockage bulkheads, each comprising a first section and a second section and a horizontal hinge joining them together along a horizontal line, each said first section being pivotally secured at one edge within said hold to said supporting and hull-reinforcing structure for swinging movement of said bulkhead from a substantially horizontal position where it does not interfere with loading, unloading, or stowing of a said cargo unit to an erected substantially vertical cargo-protecting position where said bulkhead sections form an inverted Vee with said horizontal line at the top, there being some of said bulkheads fore and some aft of the longitudinal center of said vessel, each said bulkhead when erected serving to protect cargo units against the slosh of flood water accumulated in said hold which may be induced by pitching and other motion of said vessel, a plurality of holding means at the bottom of said hold, each for engaging the free unhinged horizontal edge of a said second section, when said bulkhead is in its erected position and retaining it in that position, a plurality of unit locking means secured to said vessel for locking units to said structure after loading for obtaining buoyancy exchange between said hull and said units, each swash blockage bulkhead when erected being engaged at said horizontal line by at least one unit locking means for locking it firmly in place.

15. The vessel of claim 14 having at least one winch means for aiding in movement of said units during flotation loading and unloading, having a cable and attachment means at the end of said cable, and anchor means on said first section of each said bulkhead for attachment to said attachment means so that said winch means can be used for erection of said bulkheads.

16. The vessel of claim 15, further including second anchor means on said second section of each bulkhead for connection to said attachment means so that said winch means can be used for disengagement of and stowing of said bulkheads.

17. The vessel of claim 14 wherein each said holding means comprises a hold floor means with open slot means for engaging at least portions of a said free end.

18. The vessel of claim 17 wherein said portions of the free end of each bulkhead comprise lock feet extending in generally planar orientation from the free end for engagement by said open slot means.

19. The vessel of claim 14 wherein each said unit locking means comprises a vertically disposed cylinder secured to said supporting and hull-reinforcing structure, a piston, and a rod extending vertically upwardly out of said cylinder and carrying a downwardly directed engagement head for engagement of either an upper portion of a said cargo unit or of a said bulkhead.

20. The vessel of claim 19 wherein each said unit locking means further includes a removable spacer for interposing between said engagement head an a said bulkhead.

* * * * *

UNITED STATES PATENT AND TRADEMARK OFFICE

CERTIFICATE OF CORRECTION

PATENT NO. : 4,011,825

DATED : March 15, 1977

INVENTOR(S) : William Everett Kirby & David Jackson Seymour

It is certified that error appears in the above-identified patent and that said Letters Patent are hereby corrected as shown below:

Column 4, line 5, "in a series" should read --is a series--.

Column 5, line 9, after "may be used" insert --, including other types of spuds, as are used--.

Column 5, line 32, "bulkhead 49" should read --bulkhead 40--.

Column 5, line 37, "hereinabove" should read --hereinbefore--.

Column 8, line 31, "Figs. 7, 8, 19, 11, and 13" should read --Figs. 7, 8, 10, 11, and 13--.

Column 9, line 66, which is line 7 of claim 2, "loading an unloading" should read --loading and unloading--.

Signed and Sealed this

*second* Day of *August 1977*

[SEAL]

*Attest:*

RUTH C. MASON
*Attesting Officer*

C. MARSHALL DANN
*Commissioner of Patents and Trademarks*